US005695152A

United States Patent [19]

Levy

[11] Patent Number: 5,695,152

[45] Date of Patent: Dec. 9, 1997

[54] SYSTEM FOR CORRECTING FLIGHT TRAJECTORY OF A PROJECTILE

[75] Inventor: Benjamin Levy, Gedera, Israel

[73] Assignee: Israel Aircraft Industries LTD., Ben Gurion Int'l Airport, Israel

[21] Appl. No.: 715,035

[22] Filed: Sep. 18, 1996

[51] Int. Cl.[6] ..... F41G 7/24

[52] U.S. Cl. ..... 244/3.13

[58] Field of Search ..... 244/3.13, 3.11, 244/3.16, 3.15

[56] References Cited

U.S. PATENT DOCUMENTS

| | | | |
|---|---|---|---|
| 4,014,482 | 3/1977 | Esker et al. | 244/3.13 |
| 4,244,540 | 1/1981 | Vollmerhausen | 244/3.16 |
| 4,516,743 | 5/1985 | Sweeney et al. | 244/3.13 |
| 4,898,340 | 2/1990 | Kliger et al. | 244/3.11 |
| 4,901,946 | 2/1990 | Arnuad et al. | 244/3.13 |
| 5,082,201 | 1/1992 | Le Bars et al. | 244/3.13 |
| 5,102,065 | 4/1992 | Coudere et al. | 244/3.11 |
| 5,529,262 | 6/1996 | Horwath | 244/3.16 |

*Primary Examiner*—Michael J. Carone
*Assistant Examiner*—Theresa M. Wesson
*Attorney, Agent, or Firm*—Nikaido, Marmelstein, Murray & Oram LLP

[57] ABSTRACT

In a system including a launcher device and a projectile of the type that spins in flight, an assembly for detecting and correcting deviations of the projectile from the planned flight trajectory of the spinning projectile, leading from the launcher device to a selected, visible target, including, in combination:

a first electric signal generator associated with the launcher device;

target marker including a light emitter and being associated with the launcher;

a sensor device mounted on the projectile and spinning together with it, including sensor having a forehead and an optical assembly capable of focusing and projecting on said forehead a beam of light reflected from the target so as to draw on the forehead an imaginary circle whose radius is proportional to a real-time deviation angle defined, in a first approximation, as the angle between the tangent to the projectile's flight trajectory and the projectile's line of sight (LOS) towards the target; and a thruster initiator that is capable of activating thruster device(s) in the case that the imaginary circle radius exceeds a pre-determined value that corresponds to a predetermined largest permissible deviation angle.

36 Claims, 5 Drawing Sheets

Fig. 6
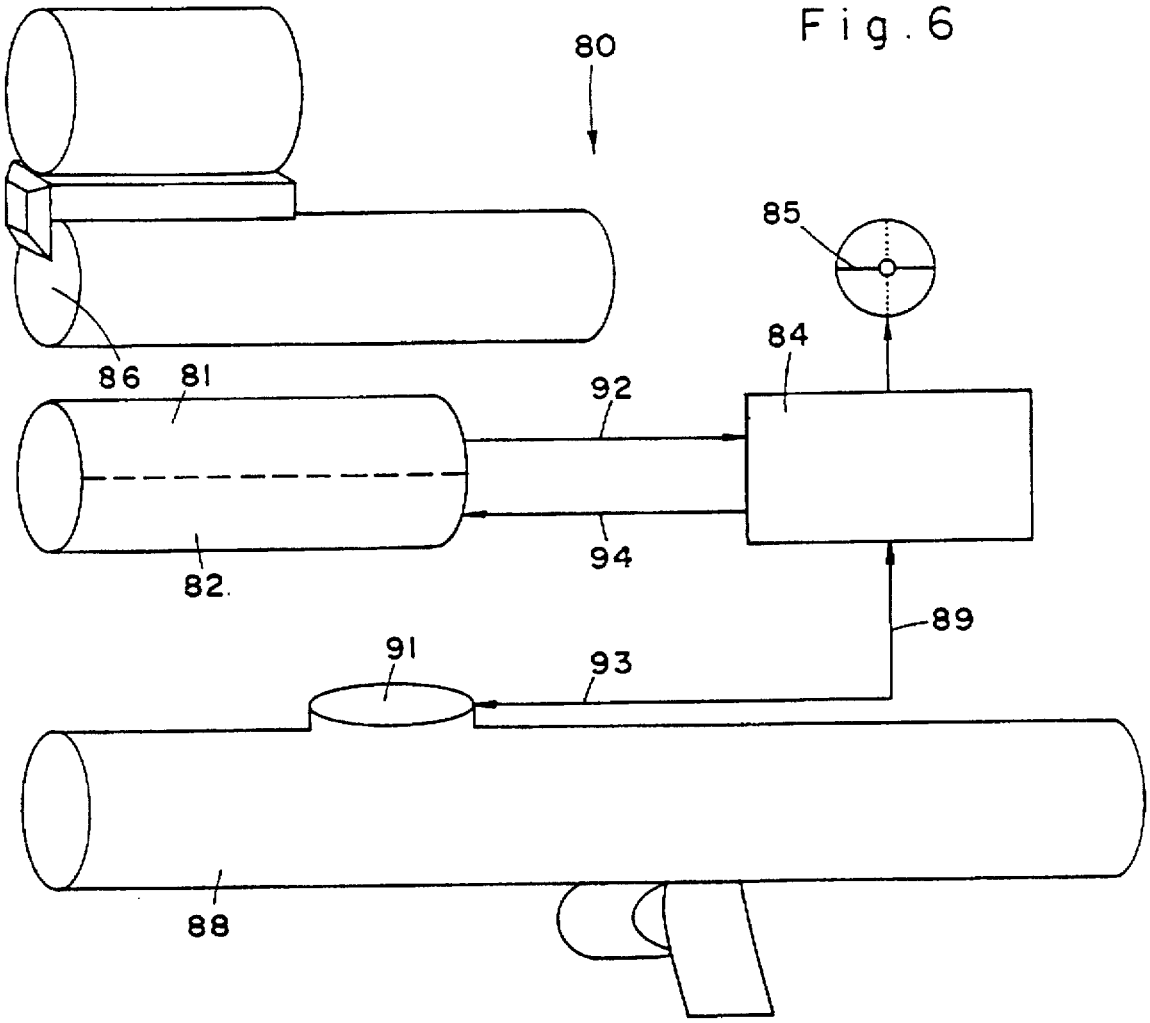
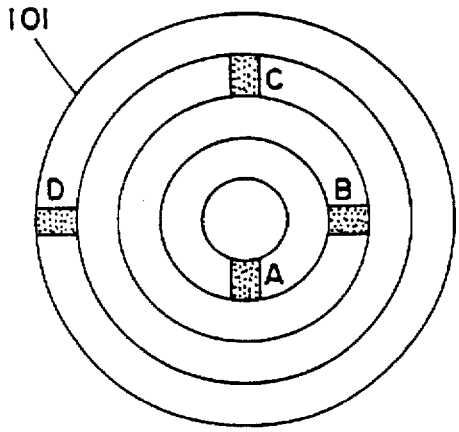
Fig. 7b
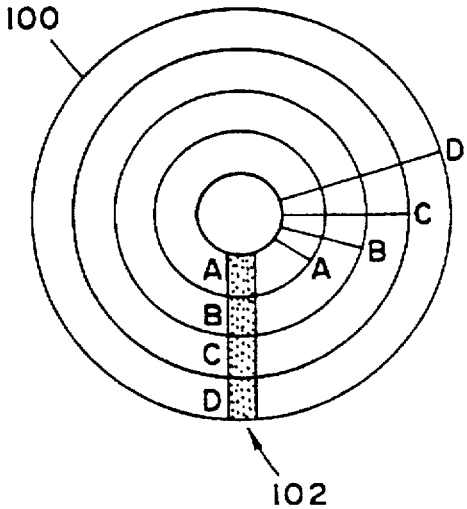
Fig. 7a

SYSTEM FOR CORRECTING FLIGHT TRAJECTORY OF A PROJECTILE

FIELD OF THE INVENTION

The present invention is in the field of spinning ballistic projectiles, i.e. unguided projectiles that fly in a ballistic trajectory towards a target while spinning about their longitudinal axis. More specifically, the present invention concerns a spinning ballistic projectile fitted with means for correcting the flight trajectory in the event of deviation from the planned trajectory.

BACKGROUND OF THE INVENTION

Unlike guided weapons, the flight trajectory of a ballistic projectile cannot be corrected in flight and any desired adjustment of the flight trajectory to surrounding conditions such as wind, expected change of position of a designated target, etc., can only be effected prior to firing, by judiciously setting the azimuth and elevation of the launching device. There exist, however, unpredictable factors which affect the projectile during its flight and cause it to deviate from its planned flight trajectory, e.g. variable flight conditions such as asymmetric frictional influences on the projectile, unexpected wind gusts and the like. Furthermore, even if the projectile deviates only slightly from its planned trajectory or even not at all, a mobile target may still be missed, notwithstanding any preliminary adjustments.

Theoretically, the problem could be solved by incorporating in the projectile known guiding or sensing means capable of performing real-time trajectory corrections either autonomically or in association with means fitted in the launching device. However, such an approach which is adequate for heavy and sophisticated projectiles such as surface-to-air missiles and various surface-to-surface tactical or strategic missiles, is cost-wise prohibitive for relatively cheap projectiles such as, for example, artillery shells.

The present invention aims to provide for the first time on a spinning ballistic projectile relatively low-cost, simple and reliable trajectory correction means capable of significantly increasing the hit probability.

GENERAL DESCRIPTION OF THE INVENTION

In the following description and claims, the term "projectile" refers quite generally to any kind of ballistic flying object; the term "launcher" or "launching device" is used to signify any kind of apparatus by which a projectile may be discharged, including but not restricted to, a large variety of static and mobile pieces of artillery, various rocket launching devices means for dropping bombs from flying platforms and others, all of which may be mounted on suitable land, marine and airborne platforms; the term "visible target", when used, signifies that there exists a line of sight (LOS) between the launcher and the designated target. It should be noted that this term is not to be construed as restricted merely to the visible region (i.e. falling in the wavelength range of 4000 to 7700 angstroms). Accordingly, a "visible target", in the sense used herein, may also be viewed at night provided that there exists a LOS between the launcher and the visible target; the term "light" means any electromagnetic radiation, not necessarily bound to the visible region, that is reflected in diffused form, and the term "forehead" used in relation to sensor means mounted on a projectile denotes that portion that faces an optical system of the sensor that concentrates and focuses light received in diffused form from a target.

The present invention is based on the realization that the ballistic flight trajectory of a projectile towards a target is characterized, inter alia, by the existence of an intrinsic deviation angle that decreases monotonically as the projectile approaches its target, which deviation angle is defined, in first approximation, as the angle between the tangent to the projectile's flight trajectory and the projectile's line-of-sight (LOS) towards the target at any given instant. By this definition, the larger the distance that the projectile has travelled in its planned flight trajectory the smaller is the deviation angle which when the projectile is about to hit the target converges to essentially zero.

Based on this characterization, the present invention seeks to make an addition to a spinning projectile which may be built in or retrofitted and which comprises a sensor device in association with thruster means such as propellant charges or pyrotechnical pursers, capable of kicking the projectile from a faulty flight trajectory resulting from an impermissible deviation angle, back into the planned flight trajectory. In the course of the projectile's flight, light arriving from the target in a diffused fashion is focused by optical concentrator means, that forms part of an optical assembly which in turn is fitted to the projectile, onto the sensor's forehead and the sensed light initiates the thruster means.

Light arriving from the target may either originate from a target marker, in which case the assembly operates by an active mode; or be the result of an intrinsic radiation of the target, e.g., infrared radiation emanating from a running engine, in which case the assembly operates by a passive mode. So as to avoid premature operation of the sensor device, timer means are provided to ensure that appropriate electric signals become operative to activate the thruster means, only upon the elapse of a predetermined period of time after launching when the projectile has passed the zenith of its trajectory and progresses in the descending part thereof, and preferably when the projectile has passed a major portion, e.g. three quarters, of its flight trajectory towards the target. Such timer means may be incorporated in the projectile, or be associated with the launcher.

The projectiles with which the present invention is concerned are of the kind that in flight spin about their longitudinal axis, e.g. due to rifling of the launcher device or due to a purposive design of stabilizing fins at the rear of a self-propelled projectile. In both the active and passive modes a portion of the diffused light arriving from the target is focused and projected on to the sensor device of the spinning projectile. If said appropriate electric signals have become operative, and if at that time the incident focused light impinges on a light sensitive portion of the sensor's forehead, the thruster will be initiated. Due to the spinning of the projectile while the light source remains essentially static, the impinging focused light draws on the forehead of the sensing device an imaginary circle concentric with the projectile, whose radius is proportional to the real-time deviation angle. For discerning between an imaginary circle drawn by the focused incident light whose radius corresponds to the largest permissible deviation angle and a circle that corresponds to an inadmissible deviation angle, the sensor's forehead comprises a "blind" inner portion large enough to include the former circle and small enough to exclude the latter circle. With a so-designed sensor, the sensing of incident light by the sensitive portion, preferably after undesired noises have been filtered out, necessarily implies that the deviation angle exceeds the largest permissible value and that for achieving a hit appropriate trajectory correction is required.

The location on the sensitive portion of the sensor at which focused incident light is detected, i.e. a region of the sensor which senses the focused incident light at a given instant, is, as a rule, indicative of the spatial direction of the real-terms deviation of the projectile from the planned flight trajectory and thus also of the direction of a required correcting thrust. Such a correcting thrust is achieved by the initiation of the thruster means fitted at selected locations of the projectile and each associated with a region of the sensitive outer portion of the sensor. By the provision of suitable means programmed processor and/or electronic module, it is ensured that when radiation impinges on the sensitive portion of the sensor's forehead and the projectile has passes a major portion of its flight trajectory towards the target, only that thruster device is initiated which is associated with a region of the light sensitive portion of the forehead on which the light impinged at a given moment. Typically, but not necessarily, it will be that region of the sensitive portion on which the light impinges first. If, however, the thruster device that is associated with the region on which light impinges first has been used up, another thruster device associated with a different region will be initiated.

Thus, in accordance with one mode of the invention there is provided in a system comprising a launcher device and a projectile of the type that spins in flight, an assembly for detecting and correcting deviations of the projectile from the planned flight trajectory of the spinning projectile, leading from said launcher device to a selected, visible target, comprising, in combination:

a first electric signal generator associated with the launcher device;

target marker comprising a light emitter and being associated with said launcher device;

a sensor device mounted on the projectile and spinning together with it, comprising sensor having a forehead and an optical assembly capable of focusing and projecting on said forehead a beam of light reflected from the target so as to draw on the forehead an imaginary circle whose radius is proportional to a real-time deviation angle defined, in a first approximation, as the angle between the tangent to the projectile's flight trajectory and the projectile's line of sight (LOS) towards the target;

said forehead comprising an inner, essentially light insensitive portion being essentially concentric with the projectile, and an outer, light sensitive portion having at least one essentially light sensitive region being capable of transforming sensed light into respective second electric signal; said outer portion having associated thereto at least one thruster device being activated in a response to respective trigger signal;

said inner portion being of a size capable of including circles with radii from zero to a critical value that corresponds to a predetermined largest permissible deviation angle, whereby said beam of light drawing on the forehead of the spinning sensor an imaginary circle having a radius larger than said critical value, impinges on said outer, portion;

thruster initiator coupled to at least one of said regions and being responsive to the respective second electric signal generated thereby, for producing said respective trigger signal; and delaying device responsive to said first electric signal, capable of generating a third electric signal to start said thruster initiator after a predetermined delay from launching.

Typically the light emitted by the target marker has a wavelength within the range of 2000–15000 angstroms. Preferably, the light emitter of the target marker is a laser beam generator.

This mode of the invention is the active mode. According to one embodiment of the active mode, the target marker means is responsive to said first electric signal, i.e. it is activated immediately upon firing. According to this embodiment, the thruster initiation means is responsive not only to said second electric signal, but also to the said third electric signal, meaning that only after a predetermined delay from the time of launching when the projectile is in the descending part of the trajectory, the thruster initiation means will take to account the second electric signal that signify that a real-time deviation angle of the flying projectile that exceeds a permissible upper value, has occurred. Put differently, the impinging light that is projected onto the sensitive portion of the sensor and which is transformed into said second electric signal, is disregarded until the delay means produces said third electric signal, pursuant to which the thruster initiation means initiates a suitable thruster device that is associated to that region of the outer portion of the forehead of the sensor on which the focused reflected light impinges and which originates said second signal, whereby the flight trajectory is corrected.

To sum up, by the latter embodiment of the active mode of the invention, the target marker means is responsive to said first electric signal whilst said thruster initiation means is responsive to both said second and third electric signals.

Preferably, but not necessarily, each sensitive region of said outer portion is associated with one or more thruster device. There may be, however, cases where only some of the sensitive regions are associated with one or more thruster device.

According to another embodiment of the active mode, the target marker means is responsive to said third electric signal, i.e. it is activated by said delay means only after the elapse of a predetermined period of time after launching, when the projectile has passed the zenith of its trajectory and progresses in the descending part thereof. Obviously, by this particular embodiment, the thruster initiation means need not be responsive to the delay means and accordingly it is responsive only to the second electric signals, for duly initiating the appropriate thruster device.

Thus, by the latter embodiment of the active mode of the invention, the target marker means is coupled to said delay means and is responsive to said third electric signal whilst said thruster initiation means is responsive to said second electric signal.

By a preferred embodiment of the active mode of the invention, said outer, light sensitive portion of the sensor's forehead comprises first and second groups of regions arranged in an alternating fashion, said first group including at least one essentially light sensitive region and said second group including at least one essentially light insensitive region. Preferably, each region of said first group is associated with at least one thruster device. The regions of the first group are typically of substantially sector-like shape such as rectangular, trapezoidal and the like. With such an arrangement, there exist a priori a correlation between a given region of the light sensitive portion whereby the duty of the thruster initiation means is simplified.

Preferably, ranger finder means is provided in association with said launcher device, for determining the range of the designated target. On the basis of range data and additional data such as the type of the projectile, the prevailing environmental conditions and others, the estimated flight duration of the projectile towards the target is readily deducible. Having determined the estimated flight duration, the delay means is capable of establishing the time interval between the instant of firing and the instant of generating said third electric signal which, as recalled, signifies that the projectile has passed a major portion of its flight trajectory towards the target.

The invention further provides for use in a system of the kind specified, a sensor having a forehead with an inner essentially light insensitive portion and an outer light sensing portion having at least one essentially light sensitive region. If desired, the outer, light sensitive portion of the sensor's forehead comprises first hand second groups of regions arranged in an alternating fashion, said first group including at least one essentially light sensitive region and said second group including at least one essentially light insensitive region.

Instead of operating by the active mode and employing a target marker, it is also possible in accordance with the invention to correct the flight trajectory of a projectile on the basis of passive target recognition. For carrying out this mode of the invention the sensor device comprises a passive infrared (respectively IR and PIR) sensor which is switched on after a predetermined delay.

Thus, in accordance with a second mode of the invention there is provided in a system comprising a launcher device and a projectile of the type that spins in flight, an assembly for detecting and correcting deviations of the projectile from the planned flight trajectory of the spinning projectile, leading from said launcher device to a selected, visible target, comprising, in combination:

a first electric signal generator associated with the launcher device;

a sensor device mounted on the projectile and spinning together with it, comprising infrared light sensor having a forehead and an optical assembly capable of focusing and projecting on said forehead a beam of infrared light emanating from the target so as to draw on the forehead an imaginary circle whose radius is proportional to a real-time deviation angle defined, in a first approximation, as the angle between the tangent to the projectile's flight trajectory and the projectile's line of sight (LOS) towards the target;

said forehead comprising an inner, essentially insensitive portion which is essentially concentric with the projectile, and an outer, sensitive portion having at least one essentially infrared light sensitive region being capable of transforming sensed infrared light into a respective second electric signal; said outer portion having associated thereto at least one thruster device being activated in response to respective trigger signal;

said inner portion being of a size capable of including circles with radii from zero to a critical value that corresponds to a predetermined largest permissible deviation angle, whereby said beam of infrared light drawing on the forehead of the spinning sensor an imaginary circle having a radius larger than said critical value, impinges on said outer, sensitive portion;

thruster initiator coupled to at least one of said regions and being responsive to the respective second electric signal generated thereby, for producing said respective trigger signal; and delaying device responsive to said first electric signal, capable of generating a third electric signal to start the operation of said thruster initiator.

Preferably, but not necessarily, each sensitive region of said outer portion is associated with one or more thruster device. There may be, however, cases where only some of the sensitive regions are associated with one or more thruster device.

Similar as in the active mode of the invention, it is preferred that the outer, sensitive portion is divided into first and second groups of regions arranged in an alternating fashion with the first group including at least one essentially infrared sensitive region being essentially capable of sensing infrared light, and said second group including at least one essentially infrared insensitive region which is essentially incapable of sensing infrared light. Preferably, each region of said first group is associated with at least one thruster device. The regions of the first group are typically of substantially sector-like shape as described in the foregoing.

In a manner similar to that of the active mode of the invention, a range finder means is, preferably, utilized in the passive mode of the invention in order to determine the delay after which the third electric signal is delivered at the output of the delay means.

Typically, the impinging infrared light that is received from the target, focused and projected onto the sensitive portion of the sensor and which is then transformed into said second electric signal, is disregarded until the delay means produces said third electric signal, pursuant to which the thruster initiation means initiates a suitable thruster device that is associated to that region of the outer portion of the forehead of the sensor on which the infrared light beam impinges and which originates said second signs, whereby the flight trajectory is corrected.

The invention further provides for use in a system according to the passive mode of the invention of the kind specified, a sensor having a forehead with an inner essentially infrared insensitive portion which is essentially incapable of sensing infrared light and an outer sensitive portion having at least one essentially infrared sensitive region which is essentially capable of sensing infrared light. If desired, the outer portion of the sensor's forehead comprises first and second groups of regions arranged in an alternating fashion, said first group including at least one essentially infrared sensitive region which is essentially capable of sensing infrared light, and said second group including at least one essentially infrared insensitive region which is essentially incapable of sensing infrared light.

There will now be describes various embodiments of the invention which concern both the active and passive mode of the invention.

Thus, by one embodiment of the invention all thruster devices are identical and produce thrusts of equal intensity.

According to another embodiment of the invention, thruster devices of different intensities are used. This embodiment is based on the characteristic that the radius of the imaginary circle drawn on the sensor's forehead is proportional to the real-time deviation angle. Accordingly, in accordance with this embodiment thrusters of different intensities are associated with two or more concentric imaginary circles on said forehead such that the larger the radius of the imaginary circle the more intense the associated thruster devices, whereby the intensity of a correcting thrust is greater the larger the real-time deviation angle.

If desired the thruster initiation means may further include noise filtering means for filtering out noises such as radiation reflected from the surroundings, thereby reducing or eliminating the possibility of generating spurious signal for initiation a thruster(s) device.

By one embodiment, the thruster devices are disposed along the circumference of the sensor such that each thruster device is responsible for a given region of the sensor. Typical, yet not exclusive, examples of thruster devices are a pyrotechnic pulser or cold gas.

If desired, the assembly of the invention is not necessarily bound to operate in a "single phase correction mode", and accordingly by a modified embodiment after having activated a thruster charge for the first time, additional phase (or phases) may be employed which involves the activation of a device (or devices) should the desired correction not be accomplished within a predetermined time interval commencing from the activation of the preceding charge. The criterion when to activate the succeeding charges is identical to the one used for activation of the first charge as described in the foregoing.

BRIEF DESCRIPTION OF THE DRAWINGS

For a better understanding, the invention will now be described, by way of example only, with reference to the accompanying drawings in which:

FIG. 6 is a block diagram of the various modules forming part of a launcher assembly, according to one embodiment of the invention; and FIGS. 7*a–b* are two plan views, showing schematically two sensors that are utilized in accordance with a modified embodiment of the invention.

DETAILED DESCRIPTION OF SPECIFIC EMBODIMENT

Figure 1:
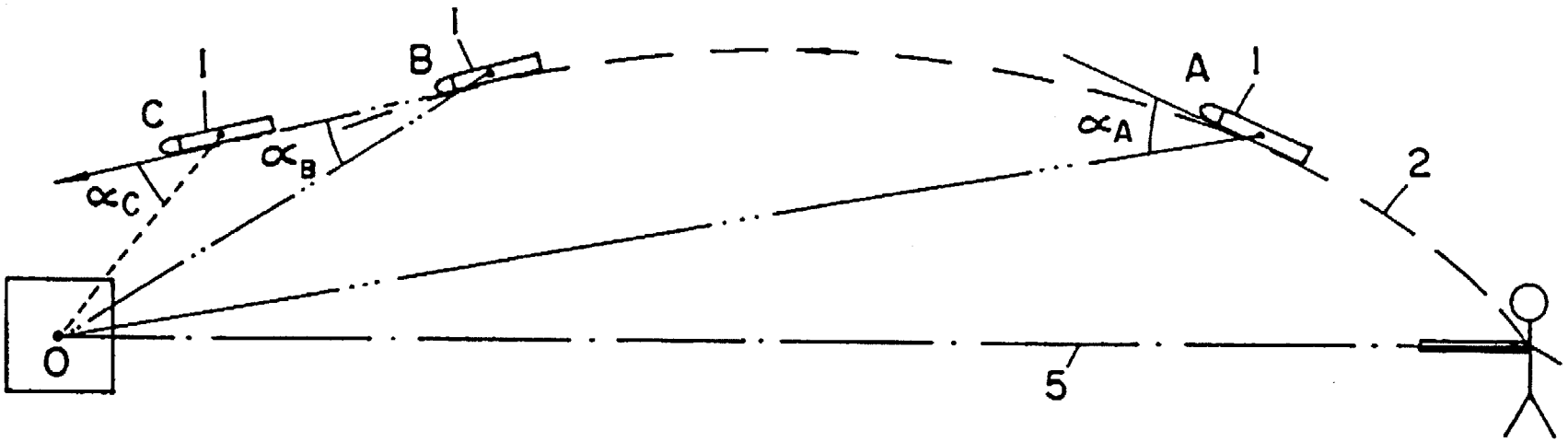
FIG. 1 is a schematic illustration of three operational phases in the flight of a projectile fitted with a sensor forming part of a system according to the invention.

Attention is first directed to FIG. 1, showing schematically three operational phases of a spinning projectile forming part of a system of the invention for detecting and correcting deviations in the flight trajectory. The projectile 1 is fired from a gun (not shown) and advances along a ballistic flight trajectory 2, towards a target 3.

As was explained in the foregoing, the ballistic flight trajectory of a projectile towards a target is characterized, inter alia, in that there exists an intrinsic deviation angle that decreases monotonically as the projectile moves along the ballistic flight trajectory. The latter characteristic is clearly illustrated by the two operational stages of projectile 1, i.e. an early stage A in which the deviation angle $\alpha_A$ (i.e. the angle between the tangent to the flight trajectory and the LOS OA), is relatively large, and an advanced phase B at which the projectile has approached the target and in which the deviation angle $\alpha_B$ (i.e. the angle between the tangent to the flight trajectory and the LOS OB), is decreased to a relatively small value. Although not shown, it is clear that if the projectile proceeds along the theoretical ballistic flight trajectory 2, the LOS towards the target and the tangent to the flight trajectory will merge into full coincidence when the projectile hits the target, or in other word, the deviation angle converges to zero. If, however, the actual flight trajectory deviates from the planned one, the deviation angle $\alpha_C$ increases as the projectile 1 approaches the target. It should be noted that for sake of convenience of description only, the deviation angles $\alpha_A$, $\alpha_B$ and $\alpha_C$ that are shown in FIG. 1, are assumed to be co-planar with trajectory 2.

Also shown in FIG., 1, is a laser beam 5 which emanates from a known per se pulsed laser (not shown), e.g. GaAs laser having peak power of 100 W and generating a laser in the $\lambda$=900 ηm range, and serving as the light source of a target marker device. The pulsed laser generator is activated after the projectile has passed the zenith of its trajectory and covered a major part of the distance to the target, e.g. three quarters of the entire flight trajectory. Accordingly, when the laser generator is activated, the deviation angle is relatively small in case the projectile moves along its planned flight trajectory.

Figure 2:
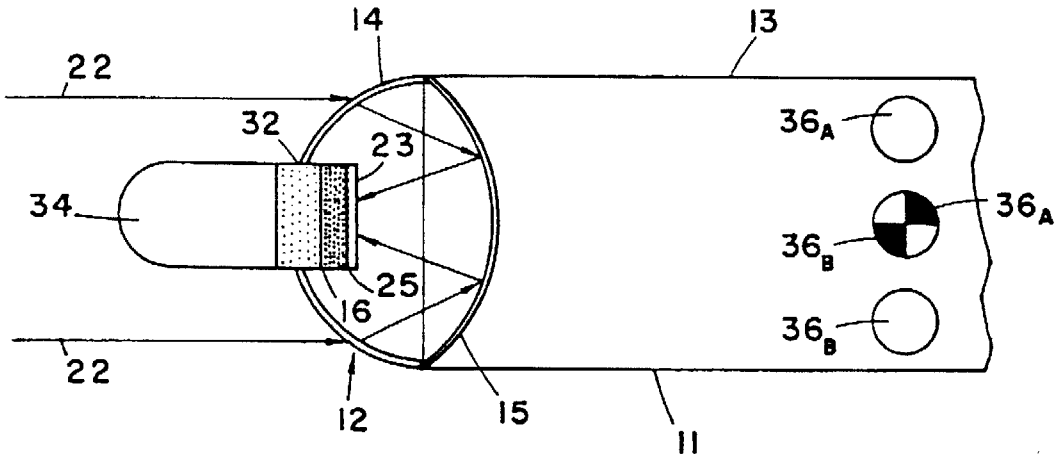
FIG. 2 is a schematic illustration of a sensor and associated thruster device fitted on the head portion of a projectile, in accordance with one embodiment of the invention.
Figure 3:
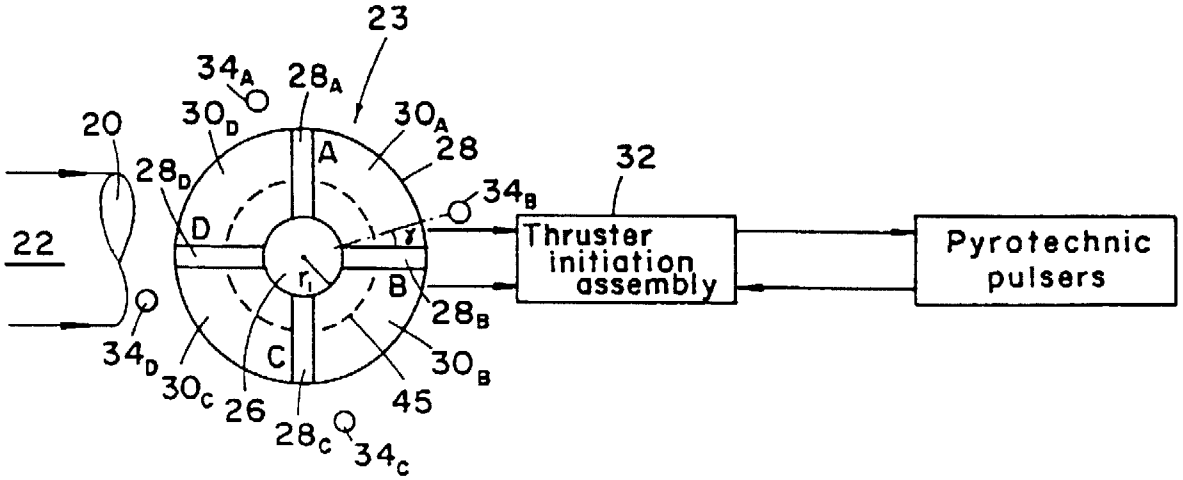
FIG. 3 is a schematic illustration of the structure of a sensor and thruster assembly, partly in a block form, according to one embodiment of the invention.

Attention is now directed to FIGS., 2 and 3 which are schematic illustrations of, respectively, a sensor and associated thruster device fitted to the head portion of a projectile 11, and a detailed structure of a sensor and thruster assembly, partly in a block form, according to one embodiment of the first mode of the invention. It should be noted, in this connection that the sensor device, thruster device and the thruster initiation means are referred to collectively as sensor and thruster assembly. As shown, dome 12 of the head portion 13 of projectile 11 comprises a lens 14 that is transparent to light within a wavelength range of interest, e.g. in the spectral region of 800–950 nm, and is fitted with a concave back mirror 15. The lens 14 together with the concave mirror 15 constitute the said optical assembly which for sake of simplicity, is represented in FIG. 3 as a lens 20. FIG. 2 also shows a sensor 16.

According to one embodiment of the invention, when the projectile has passed the zenith and covered a major portion of its flight trajectory, the laser beam generator of the target marker is switched on and light is reflected from the target in diffused form. Part of that light, marked 22, is received by lens 14 and is focused onto the concave mirror 15 from when it is further focused onto forehead 23 of a sensor 16 by the intermediary of known per se filtering means 25 that filters out light components outside the desired wavelength range. The forehead of the sensor comprises a "blind" inner portion 26 being typically but not exclusively, a circular aperture of radius $r_1$, and a segmented outer portion 28 with first and second groups of sectors arranged in an alternating fashion, the sectors of the first group being sensitive to light within the desired wavelength range, while the sectors of the second group are light insensitive. By this particular embodiment, the first group consists of four sectors $28_A$–$28_D$ and the second group of four sectors $30_A$–$30_D$, the former being made, for example, of silicon and the latter may be in form of apertures or be made of any suitable light insensitive material, e.g. silica.

It should be noted that the sensor 16 is shown in FIG. 3 in an enlarged scale and that in reality the diameter thereof is of the order of 20 mm.

The thruster initiation assembly 32 and possibly also a processor (see FIG. 3) comprises by this particular embodiment a processor and an associated electronics module (both not shown), which are fed with a respective second electric signals that is delivered from the specific sector which first sensed the impinging focused radiation, and will generate in response thereto an activation signal for initiating one or more of the thruster charges.

Figure 4:
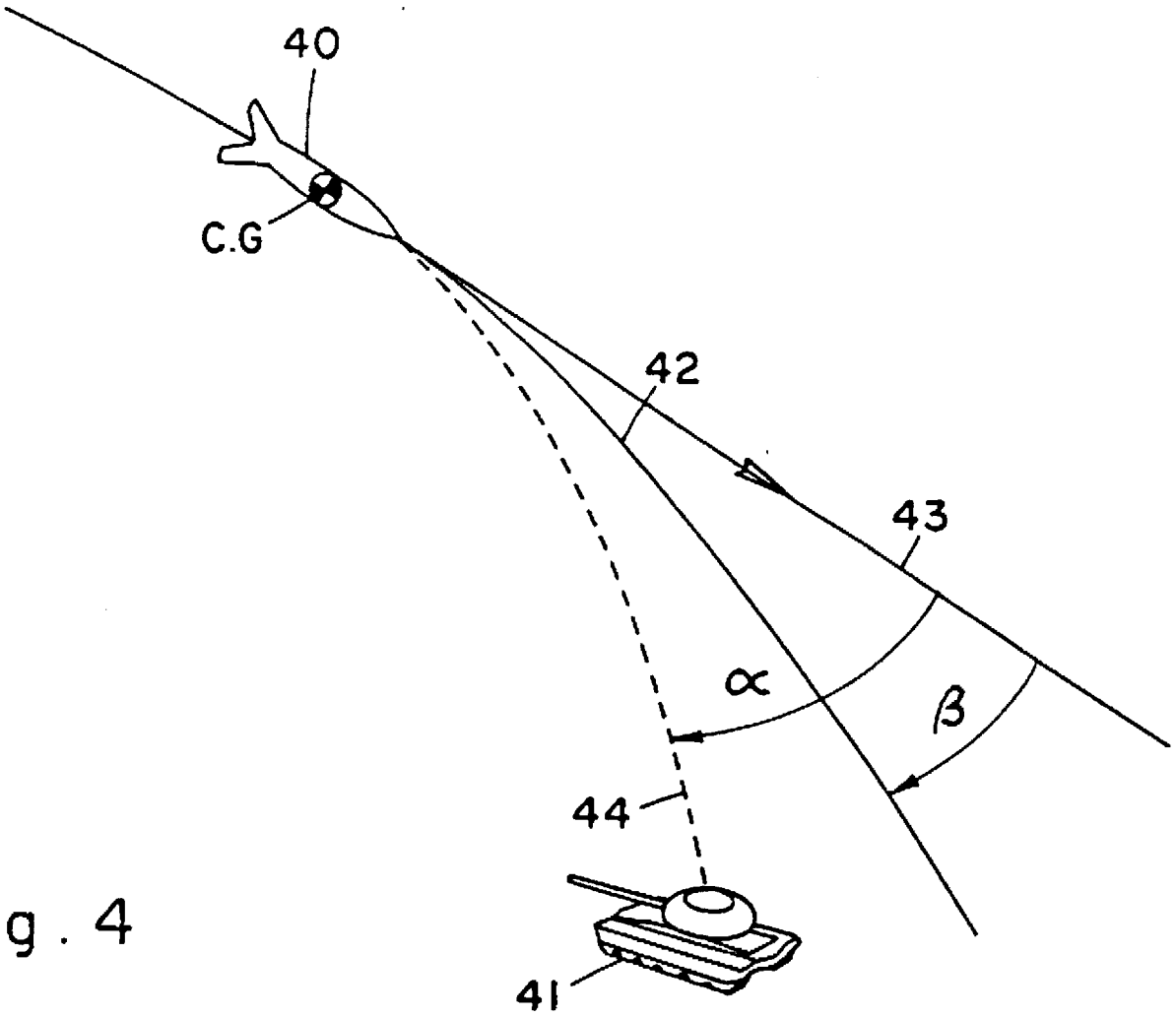
FIG. 4 is another schematic illustration of an operational stage of a projectile in a system of the invention.

For a better understanding of the foregoing attention is also directed to FIG. 4. As shown, projectile 40 that is aimed at a tank 41, is flying along a ballistic trajectory 42. The tangent to the flight trajectory is indicated by line 43, whereas the desired flight trajectory for attaining direct hit (being a close proximity to the LOS towards the target) is indicated by dashed line 44. Thus, $\alpha$ essentially stands for the deviation angle between the tangent to the flight trajectory and the LOS towards the target, whereas β stands for the intrinsic deviation angle between the tangent to the flight trajectory 43 and the ballistic trajectory 42. As is clearly shown in FIG. 4, α is larger than β, meaning that the deviation angle surpassed the maximal permissible value. Accordingly, the illuminating laser beam incident on the target 41, and reflected therefrom in diffused fashion, is partially focused and projected onto the forehead 23 of the sensor in the manner specified (see FIG. 3), and by virtue of the spinning motion of the projectile, an imaginary circle 45 is drawn by the focused light on the outer portion 28 thereof. Had the deviation angle α been smaller than the maximal permissible angle $\beta_{MAX}$, the imaginary circle 45 would have been embraced by the "blind" portion 26 of the forehead.

Figure 5:
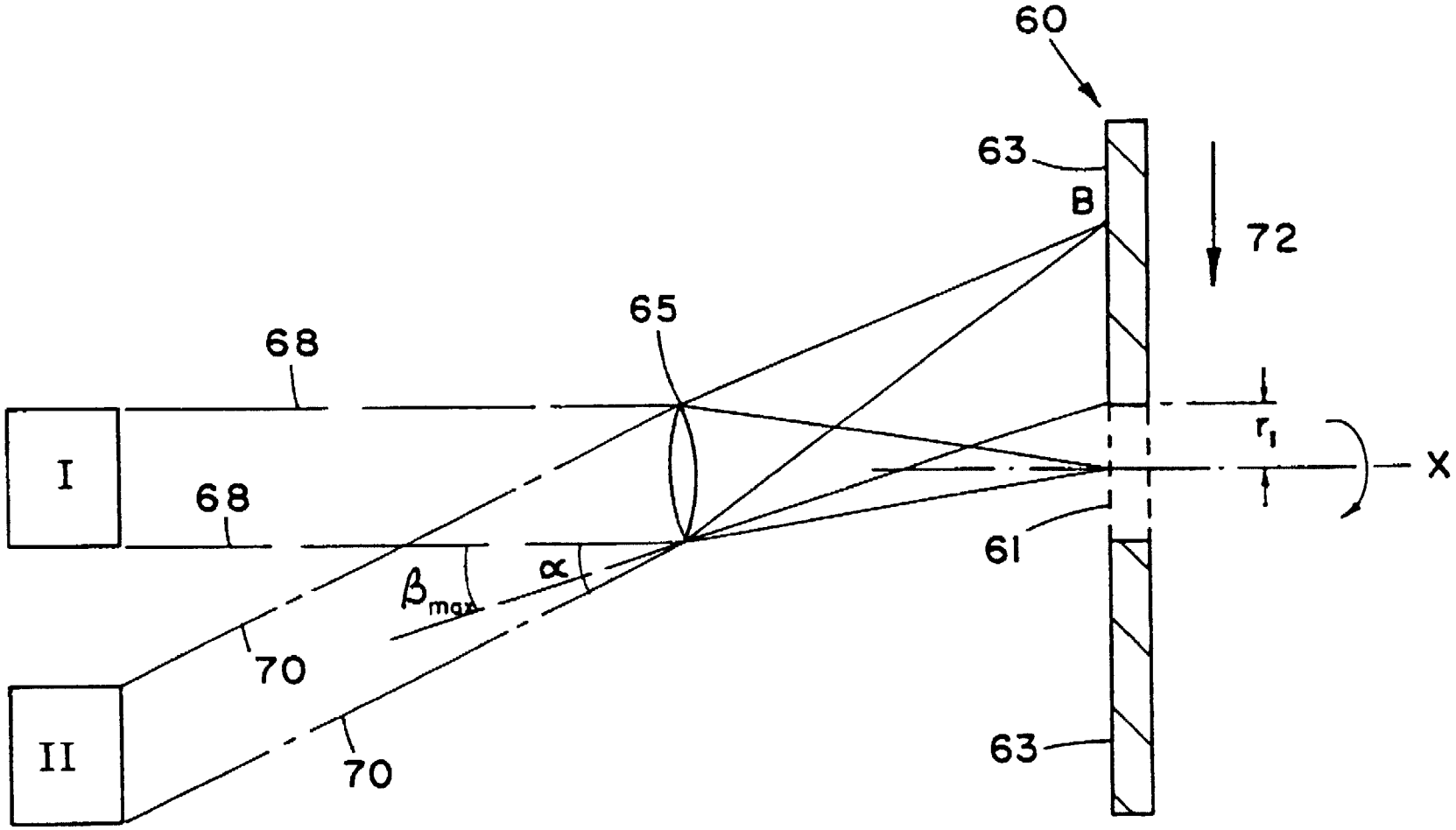
FIG. 5 is a diagrammatic model for graphically illustrating the meaning of some terms.

Attention is now directed to FIG. 5 for explaining the operation of the sensor and thruster assembly according to one embodiment of the invention, and in particular for clarifying how a deviation which surpasses the maximal permissible value $\beta_{MAX}$, results eventually in the projection of focused light outside the blind portion, i.e. onto the sensitive portion 28 of the sensor. Thus, there is shown in FIG. 5 a diagrammatic cross-sectional side elevation of the sensor 60 spinning about the longitudinal axis X, with the forehead having an inner portion 61 of radius $r_1$ and an outer, segmented portion 63 of the kind shown in FIG. 3. The sensor 60 faces lens 65 which is a simplified representation of the optical assembly.

FIG. 5 illustrates two separate scenarios. In the first of these the tangent to the projectile's flight trajectory, which is represented as dashed lines 68, coincides with the LOS towards target #I, also indicated by the dashed line 68, so that the deviation angle is zero. In the second scenario which concerns target #II, the LOS 70 deviates from the tangent to the flight trajectory 68, giving rise to a deviation angle α. Reverting to the first scenario in which the deviation angle is zero, the radiation that is reflected from the target is represented in FIG. 5 as a beam propagating along LOS 68. The beam is then projected by the optical concentrator means 65 onto the center of the "blind" portion of spinning sensor 60, with the result that no electric signal is generated at the output of sensor 60. As opposed thereto, when scenario II materializes, the reflected light that propagates along lines 70 is concentrated and focused on the sensor, impinges at a point B on the outer portion of the sensor's forehead, and by virtue of the spinning motion of the sensor, a concentric imaginary circle having a radius proportional to the real time deviation angle α is drawn by the focused light. As shown, according to scenario II, the deviation angle α exceeds the largest permissible deviation angle $\beta_{MAX}$, and hence correction of the flight trajectory is required in order to reduce the deviation angle to below $\beta_{MAX}$.

Reverting again also to FIG. 3, when the focused light impinges on a sector of the first group, e.g. $28_D$, the optical energy is transformed into an electrical signal that is fed to the processor and associated electronics module of assembly 32 for determining the appropriate pyrotechnical pulser $34_D$ that should be triggered. If, on the other hand, the focused light impinges on an insensitive sector of the second group, e.g. $30_D$, it will subsequently, after a short delay and due to the spinning of the sensor, also impinge on an adjacent sensitive sector to the first group e.g. $28_A$.

It should be noted that the radiation impinging on a given sector of the first group, inherently determines with a very high degree of certainty the spatial direction in which the projectile should be kicked in order to correct its flight trajectory, which greatly simplifies the computational complexity of the processor and associated electronics module in assembly 32.

Thins, and as shown in FIG. 5 the direction along which the flying projectile should be kicked is indicated by arrow 72 and is readily determined by the location of the sector that sensed the focused light impinging at B. In order to attain the desired thrusting effect, the thruster charges may be placed in the circumference of the sensor's forehead and essentially co-planner therewith as illustrated, for example, by pyrotechnical pulsers $34_A$–$34_D$ in FIG. 3. The shown angular offset γ with respect to sectors $28_B$ and $28_D$ is designed to compensate for the inherent delay in the pulsers'operation. Thus, radiation sensed by sensor $28_B$ will trigger the processor and associated electronics module 32 to activate pyrotechnical pulser $34_B$ which will generate the desired propelling effect along the direction of sector $28_B$. The thruster charge may also be placed differently, e.g. at the center of gravity of the projectile ($36_A$, $36_B$ in FIG. 2), provided, however, that the mutual relationship between the thruster charge and its respective sector is retained. It is, of course, not imperative to employ one thruster device for each region, and accordingly by a modified embodiment selected regions may be associated with more than one region, whereas others may have no thruster devices associated thereto at all.

A complete sequence of operation will now be described with reference to FIG. 6 showing a block diagram of the various modules forming part of a launcher assembly 80, according to one embodiment of the invention. As shown, the launcher assembly here illustrated comprises a known per se laser range finder assembly 81 and laser designator 82 (e.g. the specified GaAs laser or a diode pulsed NDYAG laser), the type of the laser being selected in accordance with various criteria such as the range of the target. For example, for ranges of few kilometers the NDYAG laser is preferable, whereas for ranges of up to 1,000 meter the GaAs laser should be utilized. Lasers 81 and 82 are associated with a ballistic computer 84 that accommodates a timer. As shown, the computer 84 is associated with crosshairs 85 integral with the telescopic optical sight 86, and with a launcher 88 for receiving therefrom a firing signal 89 by the intermediary of laser code 91.

The telescopic optical sight, the laser range finder and the laser designator are, mounted on and coordinated with the launcher 88, for duly sighting the target and determining the range thereof before firing. Upon sighting the target, i.e. bringing the image thereof into coincidence with the crosshairs, the laser range finder is activated for determining the range of the target and data indicative of the range 92 is transmitted to the ballistic computer 84 which on that basis and on the basis of pro-stored data, such as the type of the projectile, the prevailing environmental conditions and others, determines the estimated flight duration of the projectile and deducts therefrom the time interval between the instant of firing and the instant of triggering the operation of the laser designator 82.

The ballistic computer further calculates the precise required elevation of the launcher and delivers to the crosshairs visual indication which enables the operator to adjust the launcher and correct elevation position. Having set the launcher, the operator initiates a firing sequence and a fire signal is transmitted to the ballistic computer 84, which triggers the timer to operate. The operator is now compelled to re-aim the launcher so as to restore its original position, that is, placing the crosshairs in coincidence with the target. Next, as the so calculated time interval has elapsed, the signal 94, being said third electric signal, is generated to trigger the operation of the laser designator. The succeeding sequence of operations which in case of a deviation results eventually in the correction of the projectiles flight trajectory, have already been described in the foregoing.

Attention is now directed to FIGS. 7*a* and 7*b*, showing, respectively, two sensors 100 and 101, utilized in a modified embodiment of the invention. By this embodiment the system of the invention is adapted to employ a plurality of thruster means of different intensities. The electrical signal generated by the sensor in response to the projection of focused light on the respective region of the outer, sensitive portion of the sensor is indicative also of the radius of the imaginary circle on which the focused light impinges. One approach for attaining this result is illustrated in FIG. 7*a* showing a forehead of a sensor of the kind specified (in FIG. 3) with the exception that sector 102 is divided into four sub-sectors $\mathbf{102}_A$–$\mathbf{102}_D$, each sub-sector residing in a different track, indicating thus distinct radius ($r_A$–$r_D$ respectively). It is accordingly understood that an electric signal that emerges from a given sub-sector indicates the radius of the imaginary circle drawn by the impinging focused light, which is indicative of the deviation extent of the projectile from the planned trajectory. Having determined the extent of deviation, the thruster initiation assembly is further capable, according to this embodiment, of activating one or more selected thruster charges, depending upon the extent of deviation, whereby larger deviation entails the activation of a thruster charge with larger intensity.

FIG. 7*b* shows one of many possible self-explanatory variants of the arrangements shown in FIG. 7*a*.

The design procedure and operation of the various embodiments described in the foregoing, apply, mutatis mutandis, to PIR sensors made, for example, of the alloy InSb or of PbS, and adapted to sense radiation in the range of 1000–1200 nm, 3500–5000 nm, or 8000–12000 nm, depending, on the nature of the target's intrinsic light emission. If required, appropriate sensor cooling means are also utilized.

I claim:

1. In a system comprising a launcher device and a projectile of the type that spins in flight, an assembly for detecting and correcting deviations of the projectile from the planned flight trajectory of the spinning projectile, leading from said launcher device to a selected, visible target, comprising, in combination:

a first electric signal generator associated with the launcher device;

target marker comprising a light emitter and being associated with said launcher device;

a sensor device mounted on the projectile and spinning together with it, comprising a sensor having a forehead and an optical assembly capable of focusing and projecting on said forehead a beam of light reflected from the target so as to draw on the forehead an imaginary circle whose radius is proportional to a real-time deviation angle defined, in a first approximation, as the angle between the tangent to the projectile's flight trajectory and the projectile's line of sight (LOS) towards the target;

said forehead comprising an inner, essentially light insensitive portion being essentially concentric with the projectile, and an outer, light sensitive portion having at least one essentially light sensitive region being capable of transforming sensed light into respective second electric signal; said outer portion having associated thereto at least one thruster device being activated in a response to respective trigger signal;

said inner portion being of a size capable of including circles with radii from zero to a critical value that corresponds to a predetermined largest permissible deviation angle, whereby said beam of light drawing on the forehead of the spinning sensor an imaginary circle having a radius larger than said critical value, impinges on said outer, portion;

thruster initiator coupled to at least one of said regions and being responsive to the respective second electric signal generated thereby, for producing said respective trigger signal; and delaying device responsive to said first electric signal, capable of generating a third electric signal to start said thruster initiator after a predetermined delay from launching.

2. The assembly according to claim 1, wherein said outer, light sensitive portion of the sensor's forehead comprises first and second groups of regions arranged in an alternating fashion, said first group including at least one essentially light sensitive region and said second group including at least one essentially light insensitive region.

3. The assembly according to claim 2, wherein the regions of the first group are typically of substantially sector-like shape.

4. The assembly according to claim 1, wherein at least one of said essentially light sensitive regions are associated, each, with at least one thruster device.

5. The assembly according to claim 1, wherein said target marker is responsive to said first electric signal and said thruster initiation processor is further coupled to said delay device and is responsive to both said second and third electric signals.

6. The assembly according to claim 1, wherein the target marker is coupled to said delay device and is responsive to said third electric signal; said thruster initiator is responsive to said second electric signal.

7. The assembly according to claim 1, wherein the light emitted by the target marker has a wavelength within the range of 2000–15000 angstroms.

8. The assembly according to claim 1, wherein the light emitter of the target marker is a laser beam generator.

9. For use in the system according to claim 1, a sensor having a forehead with an inner essentially light insensitive portion and an outer light sensitive portion having at least one region being essentially capable of sensing light.

10. The sensor according to claim 9, wherein the light sensitive portion of the sensor's forehead comprises first and second groups of regions arranged in an alternating fashion, said first group including at least one essentially light sensitive region and said second group including at least one essentially light insensitive region.

11. The assembly according to claim 1, wherein a ranger finder is provided in association with said launcher device and said delay device, for determining the range data of the target, and on the basis of at least said range data, the estimated flight duration of the projectile towards the target is deducible, whereby the delay device is capable of establishing a time interval between the instant of firing and the instant of generating said third electric signal.

12. The assembly according to claim 1, wherein all thruster devices are identical and produce thrusts of equal intensity.

13. The assembly according to claim 1, wherein thruster devices of different intensities are used.

14. The assembly according to claim 13, wherein thrusters of different intensities are associated with two or more concentric imaginary circles on said forehead such that the larger the radius of the imaginary circle the more intense the associated thruster devices, whereby the intensity of a correcting thrust is greater the larger the real-time deviation angle.

15. The assembly according to claim 1, wherein the thruster initiator further includes noise filter for filtering out noises.

16. The assembly according to claim 1, wherein at least one thruster devices is disposed along the circumference of the sensor such that each thruster device is responsible for a given region of the sensor.

17. The assembly according to claim 1, wherein at least one thruster device is placed at the center of gravity of the projectile such that the mutual relationship between each thruster device and is respective segment is retained.

18. The assembly according to claim 1, wherein at least one thruster device is a pyrotechnic pulser.

19. The assembly according to claim 1, wherein at least one thruster devices is a cold-gas operated thruster.

20. The assembly according to claim 1, capable of activating different thruster devices at successive time durations, should the desired correction not be accomplished within a predetermined time interval commencing from the activation of the preceding charge.

21. In a system comprising a launcher device and a projectile of the type that spins in flight, an assembly for detecting and correcting deviations of the projectile from the planned flight trajectory of the spinning projectile, leading from said launcher device to a selected, visible target, comprising, in combination:

a first electric signal generator associated with the launcher device;

a sensor device mounted on the projectile and spinning together with it, comprising an infrared light sensor having a forehead and an optical assembly capable of focusing and projecting on said forehead a beam of infrared light emanating from the target so as to draw on the forehead an imaginary circle whose radius is proportional to a real-time deviation angle defined, in a first approximation, as the angle between the tangent to the projectile's flight trajectory and the projectile's line of sight (LOS) towards the target;

said forehead comprising an inner, essentially insensitive portion which is essentially concentric with the projectile, and an outer, sensitive portion having at least one essentially infrared light sensitive region being capable of transforming sensed infrared light into a respective second electric signal; said outer portion having associated thereto at least one thruster device being activated in response to respective trigger signal;

said inner portion being of a size capable of including circles with radii from zero to a critical value that corresponds to a predetermined largest permissible deviation angle, whereby said beam of infrared light drawing on the forehead of the spinning sensor an imaginary circle having a radius larger than said critical value, impinges on said outer, sensitive portion;

thruster initiator coupled to at least one of said regions and being responsive to the respective second electric signal generated thereby, for producing said respective trigger signal; and delaying device responsive to said first electric signal, capable of generating a third electric signal to start the application of said thruster initiator.

22. The assembly according to claim 21, the outer, sensitive portion is divided into first and second groups of regions arranged in an alternating fashion with the first group including at least one essentially infrared sensitive region being essentially capable of sensing infrared light, and said second group including at least one essentially infrared insensitive region which is essentially incapable of sensing infrared light.

23. The assembly according to claim 22, wherein the regions of the first group are typically of substantially sector-like shape.

24. The assembly according to claim 21, wherein at least one of said essentially infrared sensitive regions are associated, each, with at least one thruster device.

25. For use in the system according to claim 21, a sensor having a forehead with an inner essentially infrared insensitive portion which is essentially incapable of sensing infrared light and an outer essentially infrared sensitive portion which is essentially capable of sensing infrared light.

26. The sensor of claim 25, wherein the outer portion of the sensor's forehead comprises first and second groups of regions arranged in an alternating fashion, said first group including at least one essentially infrared sensitive region which is essentially capable of sensing infrared light, and said second group including at least one essentially infrared insensitive region which is essentially incapable of sensing infrared light.

27. The assembly according to claim 21, wherein a ranger finder is provided in association with said launcher device and said delay device, for determining the range data of the target, and on the basis of at least said range data, the estimated flight duration of the projectile towards the target is deducible, whereby the delay device is capable of establishing a time interval between the instant of firing and the instant of generating said third electric signal.

28. The assembly according to claim 21, wherein all thruster devices are identical and produce thrusts of equal intensity.

29. The assembly according to claim 21, wherein thruster devices of different intensities are used.

30. The assembly according to claim 29, wherein thrusters of different intensities are associated with two or more concentric imaginary circles on said forehead such that the larger the radius of the imaginary circle the more intense the associated thruster devices, whereby the intensity of a correcting thrust is greater the larger the real-time deviation angle.

31. The assembly according to claim 21, wherein the thruster initiator further includes noise filter for filtering out noises.

32. The assembly according to claim 21, wherein at least one thruster device is disposed along the circumference of the sensor such that each thruster device is responsible for a given region of the sensor.

33. The assembly according to claim 21, wherein at least one thruster device is placed at the center of gravity of the projectile such that the mutual relationship between each thruster device and its respective segment is retained.

34. The assembly according to claim 21, wherein at least one thruster device is a pyrotechnic pulser.

35. The assembly according to claim 21, wherein at least one thruster devices is a cold-gas operated thruster.

36. The assembly according to claim 21, capable of activating different thruster devices at successive time durations, should the desired correction not be accomplished within a predetermined time interval commencing from the activation of the preceding charge.

* * * * *